US010773876B2

(12) United States Patent
Pakmanesh et al.

(10) Patent No.: US 10,773,876 B2
(45) Date of Patent: Sep. 15, 2020

(54) PACKAGING SYSTEM FOR SHIPPING FLORAL ARRANGEMENTS

(71) Applicant: Roseshire Corporation, Concord, CA (US)

(72) Inventors: Nasim Pakmanesh, Concord, CA (US); Donald Gene Hotton, Concord, CA (US)

(73) Assignee: Roseshire Corporation, Concord, CA (US)

( * ) Notice: Subject to any disclaimer, the term of this patent is extended or adjusted under 35 U.S.C. 154(b) by 502 days.

(21) Appl. No.: 15/422,347

(22) Filed: Feb. 1, 2017

(65) Prior Publication Data

US 2017/0217668 A1 Aug. 3, 2017

Related U.S. Application Data

(60) Provisional application No. 62/289,869, filed on Feb. 1, 2016.

(51) Int. Cl.
*B65D 85/50* (2006.01)
*B65D 77/04* (2006.01)
*B65D 81/107* (2006.01)

(52) U.S. Cl.
CPC ..... *B65D 85/505* (2013.01); *B65D 77/042* (2013.01); *B65D 81/107* (2013.01)

(58) Field of Classification Search
CPC . A61G 5/06; B65D 5/50; B65D 77/04; B65D 77/042; B65D 77/10; B65D 77/22;
(Continued)

(56) References Cited

U.S. PATENT DOCUMENTS 1,270,554 A 6/1918 Rubel
2,774,187 A * 12/1956 Smithers ..... B65D 85/505 206/423

(Continued)

FOREIGN PATENT DOCUMENTS

JP 2010-3165160 U * 12/2010 ..... B65D 85/50
JP 2011-42389 A * 3/2011 ..... B65D 85/50

OTHER PUBLICATIONS

U.S. Trademark Registration—4941111 (Roseshire) issued Apr. 19, 2016 (registered).†

(Continued)

*Primary Examiner* — Bryon P Gehman
(74) *Attorney, Agent, or Firm* — Brian Beverly; Beeson Skinner Beverly, LLP

(57) ABSTRACT

A packaging system for shipping floral arrangements includes an elongated presentation box sized to hold a floral arrangement, such as a dozen roses. The presentation box includes two long side panels, a floor panel extending between the side panels, head end and a stem end panels each extending between the side and floor panels, a top opening defined by the side and end panels, and an elongated inner lid hingedly connected on one of its long sides to one of the side panels. The inner lid extends longitudinally from a first end adjacent to the stem end panel to a second end spaced away from the head end panel such that it folds over only a portion of the top opening and creates a presentation opening bounded by the head end panel, side panels and the second end of the inner lid for displaying the flowers of the floral arrangement.

14 Claims, 11 Drawing Sheets

(58) Field of Classification Search
CPC ..... B65D 81/107; B65D 81/18; B65D 85/50; B65D 85/505
USPC ..... 206/423, 784; 47/84
See application file for complete search history.

(56) References Cited

U.S. PATENT DOCUMENTS

| | | | | |
|---|---|---|---|---|
| 5,356,023 | A | 10/1994 | Krupa | |
| 6,039,180 | A | 3/2000 | Grant | |
| 6,302,271 | B1 | 10/2001 | Grant | |
| 6,463,697 | B2 * | 10/2002 | Weder | B65D 85/505 47/84 |
| 7,219,797 | B2 * | 5/2007 | Kroeze | B65D 5/5016 206/423 |
| 7,584,855 | B2 * | 9/2009 | Rutstrom | B65D 85/505 206/784 |
| 9,211,997 | B2 * | 12/2015 | Rutstrom | B65D 85/505 |
| 2002/0189963 | A1 | 12/2002 | Weder et al. | |
| 2007/0246387 | A1 | 10/2007 | Anhut | |
| 2017/0291758 | A1 * | 10/2017 | Muzzall | B65D 5/50 |

OTHER PUBLICATIONS

Internet webpage at Luxexpose.com/roseshire-first-luxury-roses-delivery-brand, Feb. 10, 2015.†

* cited by examiner
† cited by third party

PACKAGING SYSTEM FOR SHIPPING FLORAL ARRANGEMENTS

CROSS-REFERENCE TO RELATED APPLICATIONS

This application claims the benefit of U.S. Provisional Application No. 62/289,869 filed Feb. 1, 2016.

BACKGROUND

Field of the Invention

This invention relates to packaging systems and in particular to a packaging system for shipping of a floral arrangement.

Discussion of the Prior Art

Floral arrangements, such as an arrangement of long stem roses, are frequently shipped in an elongated box which, when opened, reveals the entire arrangement. There are several problems with this traditional method of shipping a floral arrangement.

Flowers are inherently fragile, so the normal jostling experienced by a floral arrangement during shipping can damage or degrade it. The life of a cut flower can be minimized if the flower is not properly hydrated, kept at a cool temperature, and ventilated. Hydration tubes can be used to provide a supply of water to the stem of each flower, but they tend to move around in the box, which can disturb the arrangement such as by pushing the flowers against one end of the box. Boxes used for shipping floral arrangements have made no provision for keeping the floral arrangement cool or ventilated because humidity can weaken the paper material forming the box and vents in the box can weaken it structurally.

DETAILED DESCRIPTION OF THE ILLUSTRATED EMBODIMENTS

Figure 1:
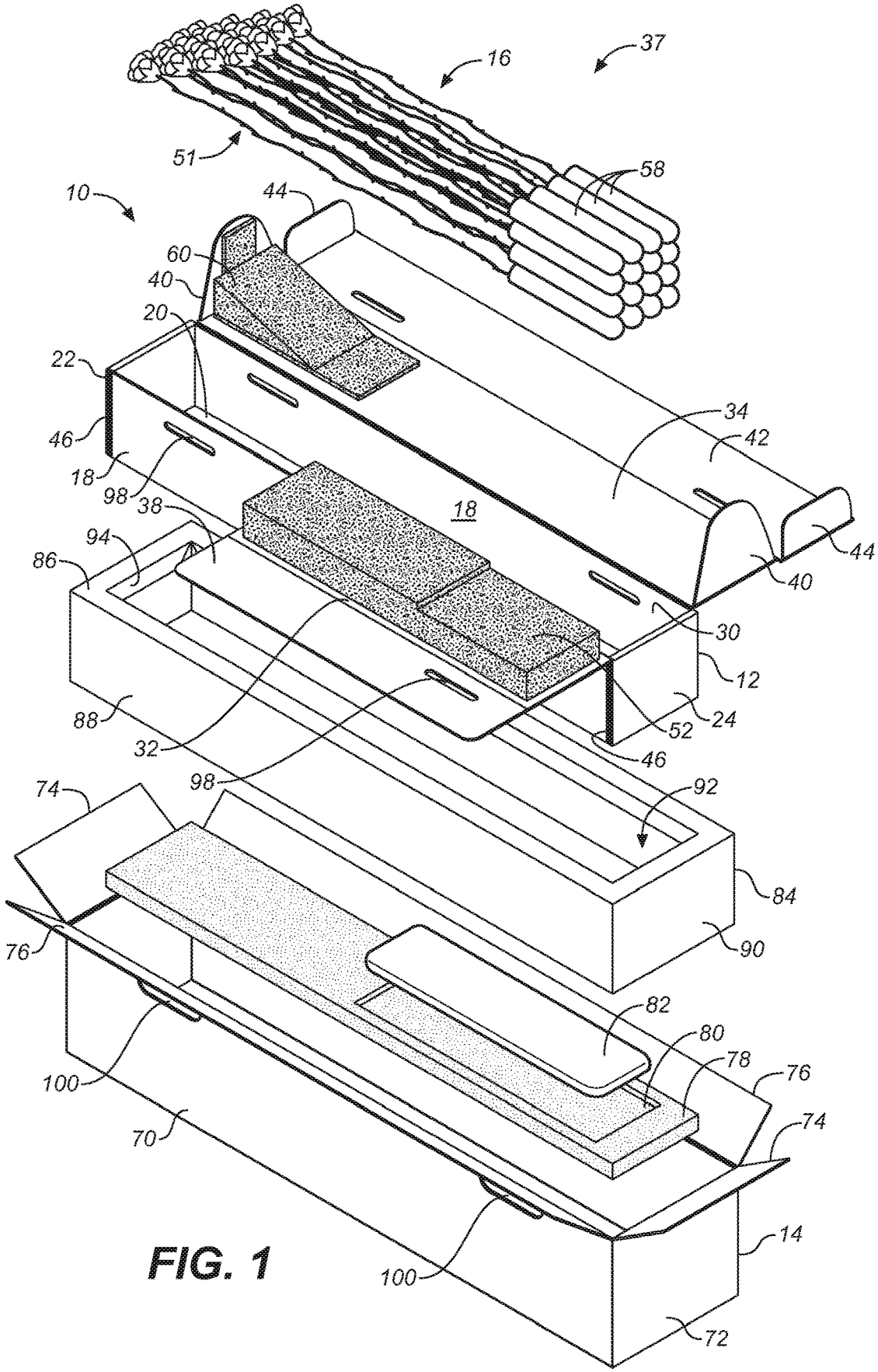
FIG. 1 is an exploded perspective view of a packaging system for delivery of a floral arrangement according to the invention.
Figure 2:
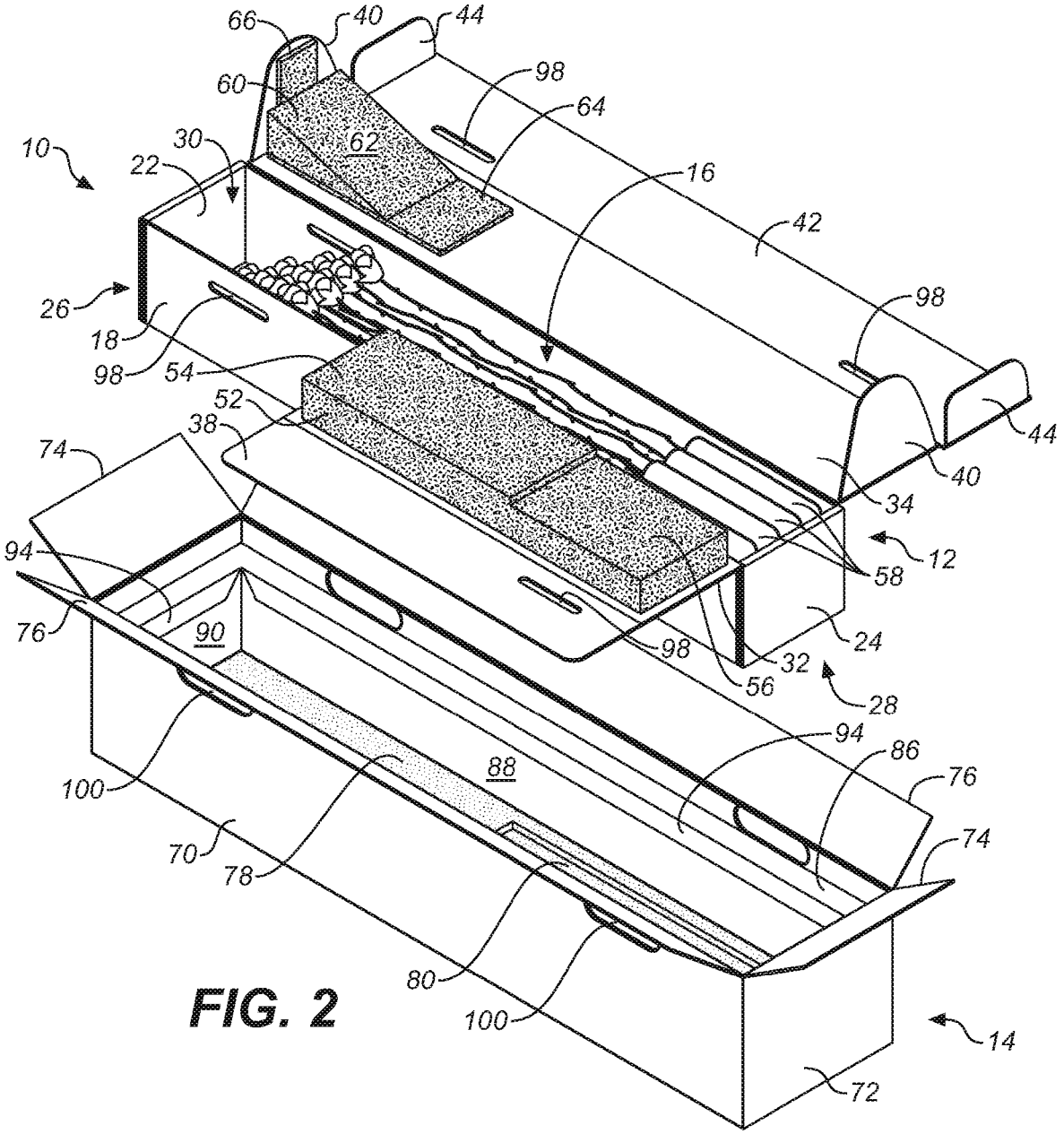
FIG. 2 is an exploded perspective view of the assembled presentation box and of the shipping box thereof.

A packaging system for delivery of a floral arrangement is indicated generally in FIGS. 1 and 2 at numeral 10. The system 10 comprises an elongated presentation box 12 and a shipping box 14 for shipping the presentation box. The presentation box 12 is sized for holding a floral arrangement 16 such as a dozen long stem roses, and includes two long side panels 18, a floor panel 20, a head end panel 22 and a stem end panel 24 forming an elongated container having a head end 26, a stem end 28, a top opening 30, and inner and outer lids 32, 34 for closing over the top opening 30.

Figure 4:
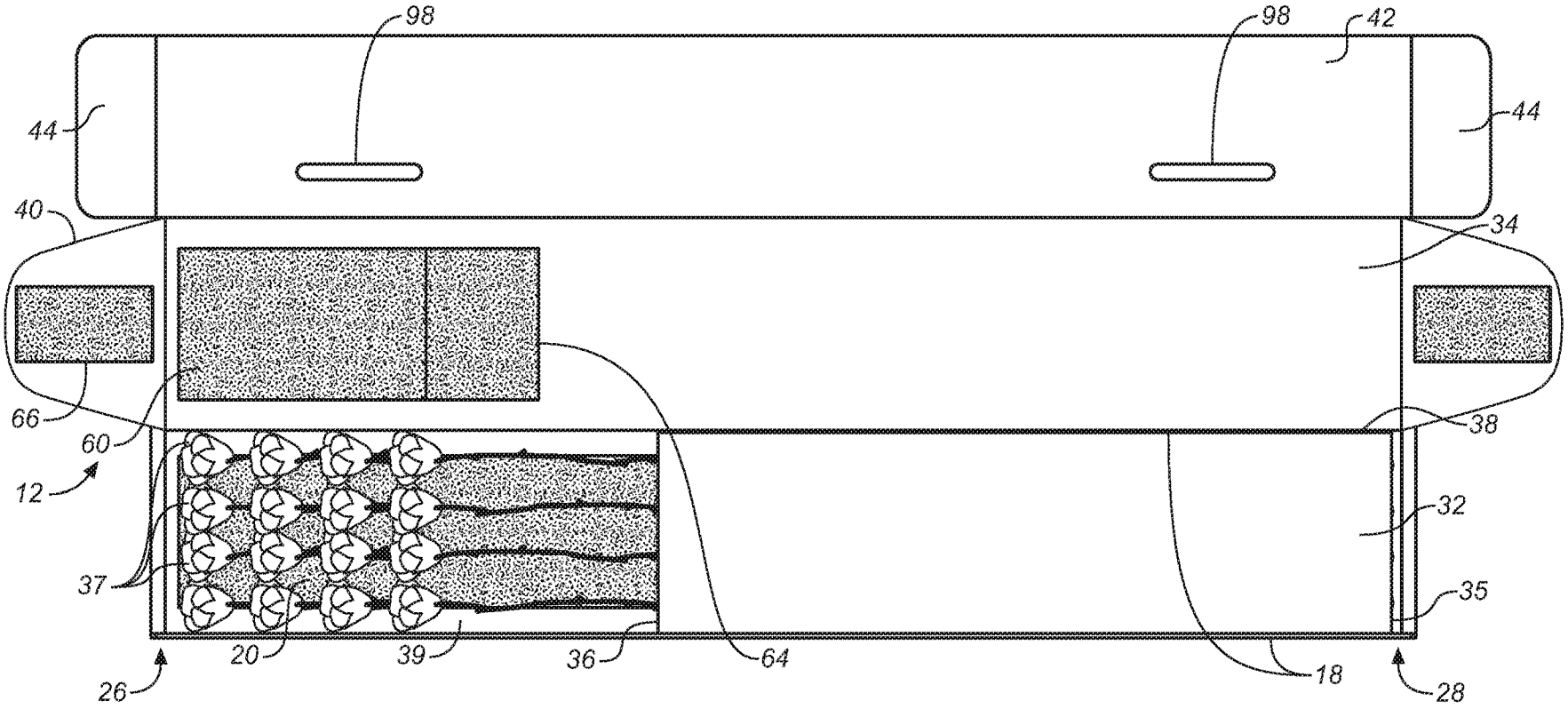
FIG. 4 is a top plan view of the presentation box thereof shown with the inner id closed and the outer lid open.

The inner lid 32 is hingedly connected on one of its long sides to one of the side panels 18 allowing it to close over the top opening 30. With additional reference now to FIG. 4, it is seen that the inner lid 32 extends longitudinally from its first end 35 adjacent the stem end 28 of the presentation box 12 to a second end 36 terminating well short of the head end 26 thereof. In the closed configuration shown in FIGS. 4 and 5A, inner lid 32 is folded over a portion of the top opening 30 of the presentation box 12 thereby creating a presentation opening 39 at the head end 26 thereof for display of the flowers 37 of a floral arrangement 16 placed therein. A closure panel 38 is hingedly attached to the other of the long sides of the inner lid 32 and is frictionally engaged with the inner face of the other side panel 18 of the presentation box to hold inner lid 32 in the closed position shown.

The outer lid 34 is hingedly connected on one of its long sides to the upper end of the other of the side panels 18 of the presentation box 12 for folding over and closing the top opening 30. Two end flaps 40 are hingedly attached to the short sides of outer lid 34, a locking panel 42 is hingedly attached to the other long side of outer lid 34, and two locking flaps 44 are hingedly attached to the ends of the locking panel 42. In the closed configuration shown in FIG. 5A, outer lid 34 is secured over top opening 30 by the two end flaps 40 which tuck into the head end 26 and stem end 28 of the presentation box. Locking panel 42 folds alongside one of the side panels 18 of the presentation box 12 and locking flaps 44 are inserted snugly in locking slots 46 formed in the head end and stem end panels 26, 28 to fix locking panel 42 in place and secure outer lid 34 in the closed position over the top opening 30.

Figure 3:
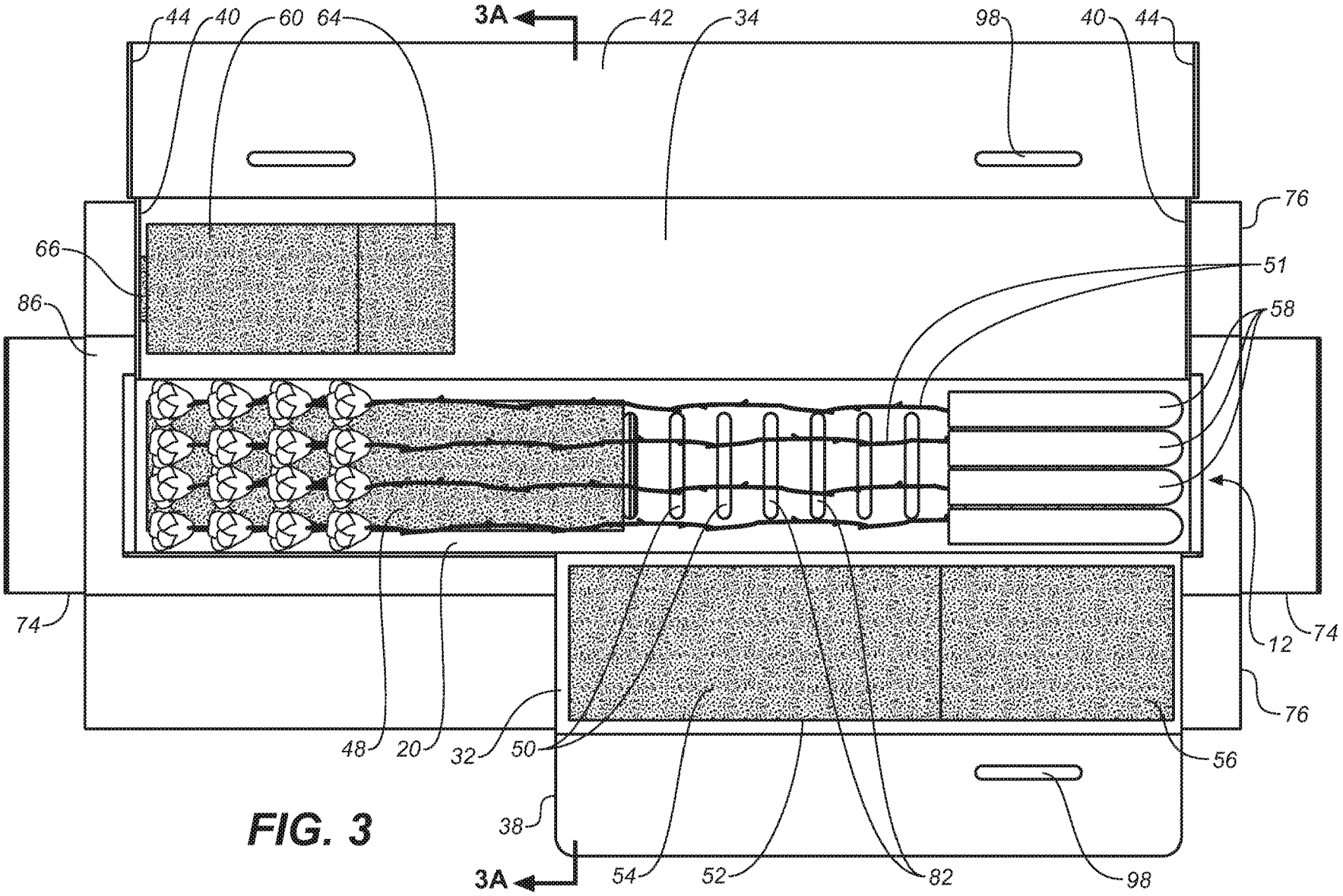
FIG. 3 is a top plan view thereof with the lids of the presentation and shipping boxes open.

As seen in FIG. 3, a bottom support pad 48 is provided on the head end of the floor panel 20 of the presentation box 12 to provide a protective surface on which the flowers 37 of a floral arrangement can be supported. An optional tube-supporting pad 49 is provided on the floor panel 20 near the stem end 28 of the box 12 (see FIG. 6). An array of vents 50 in the floor panel 20 are located for disposition immediately below the stems 51 of a floral arrangement 16 placed in the box 12. Similarly, with reference to FIGS. 1-3, a stem-holding support pad 52 is provided on the underside of inner lid 32. Pad 52 includes a thicker stem-holding portion 54 for holding the stems 51 of the floral arrangement 16, and a tube-holding portion 56 thinner than the stem-holding portion 54 for holding hydration tubes 58, each tube containing one of the stems 51 of the floral arrangement 16 when the inner lid 32 is in the closed position. Pads 48, 49 and 50 can be made of foam, cardboard or any other material that is suitably lightweight and supportive.

Figure 3A:
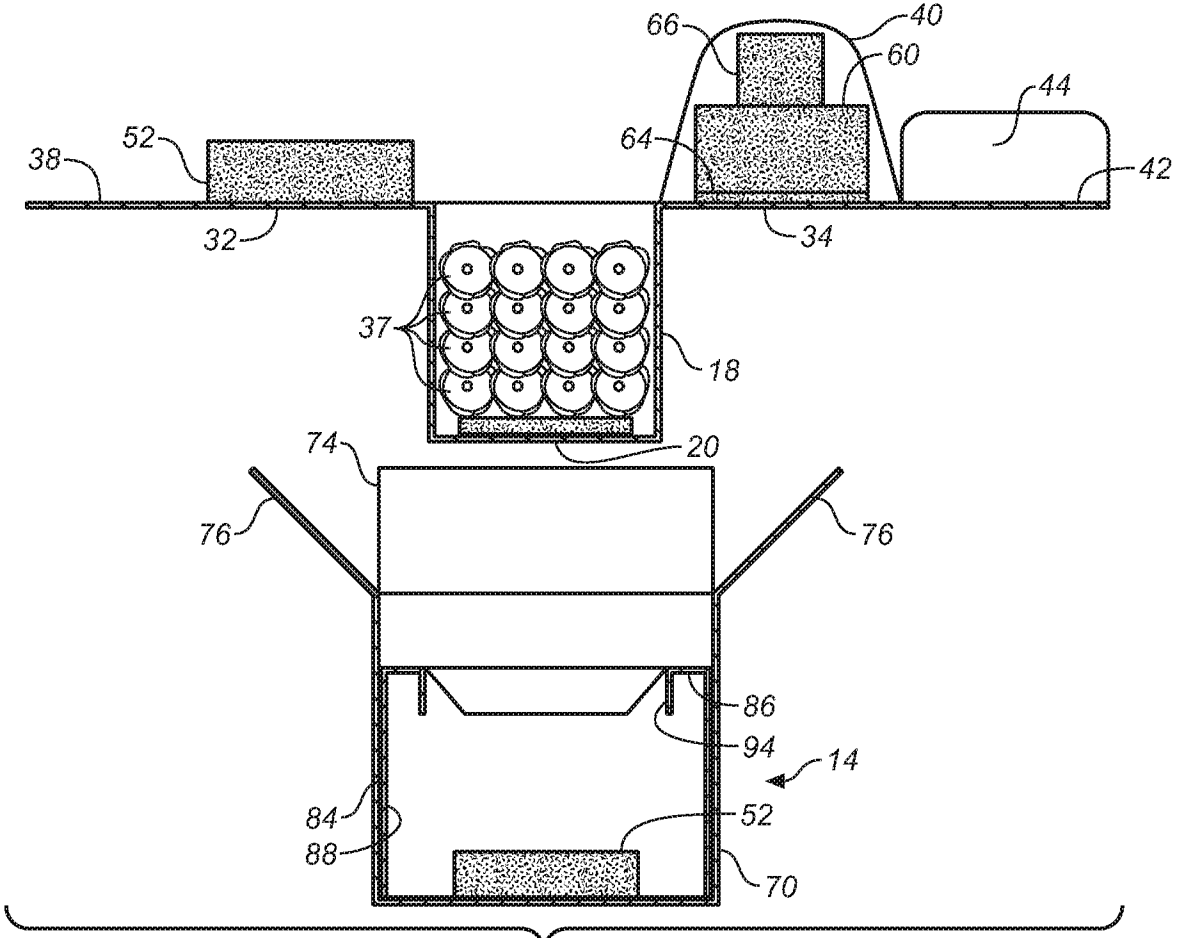
FIG. 3A is an exploded sectional view of the packaging system of FIG. 3 taken along lines 3A-3A thereof.
Figure 7:
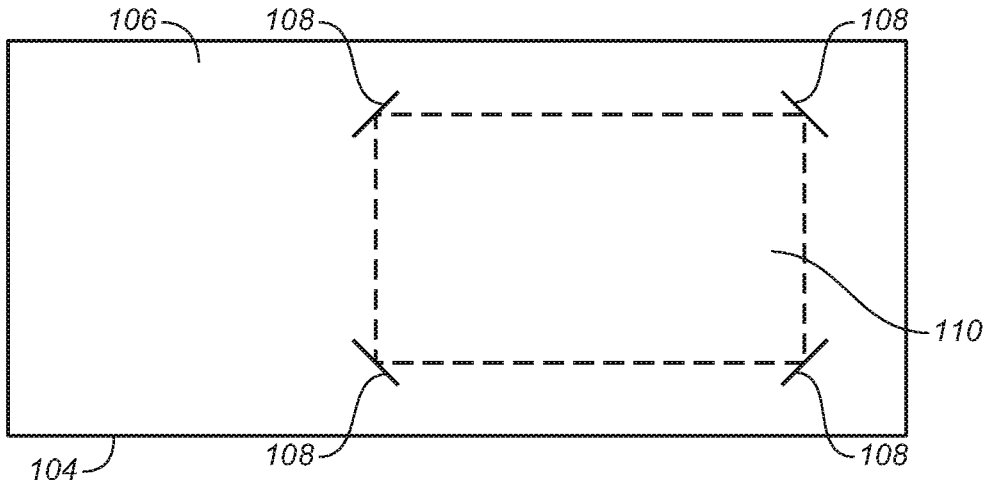
FIG. 7 is a plan view of the back side of a backing plate in another embodiment of the invention holding a note card.
Figure 8:
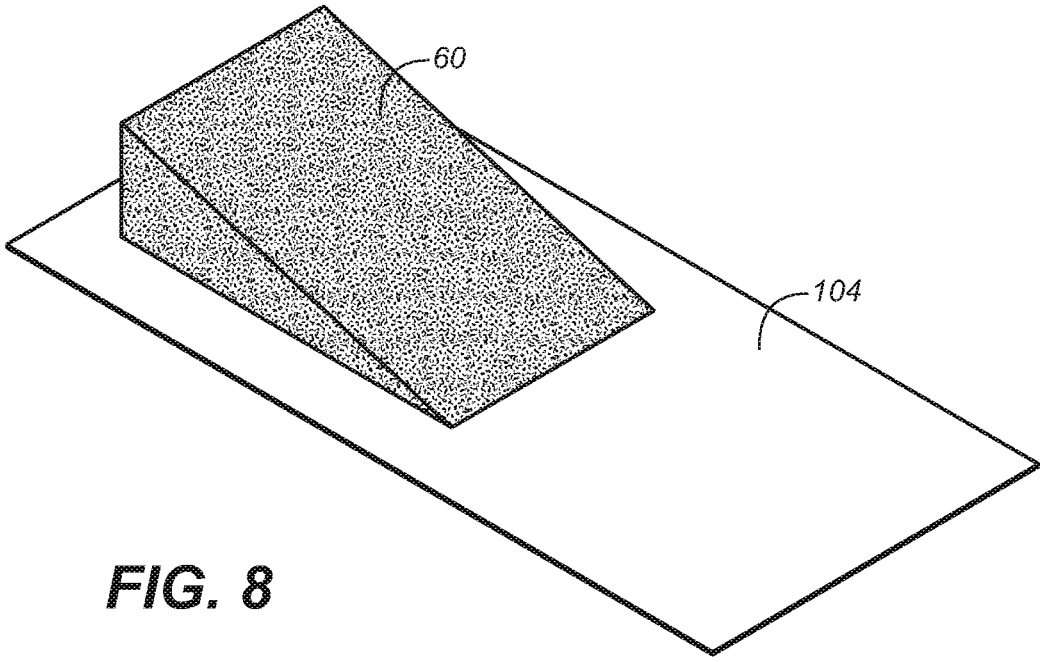
FIG. 8 is a perspective view of the opposite side of the backing plate shown in FIG. 7 to which the wedge-shaped support pad that retains the floral arrangement is attached.

With particular reference to FIGS. 1, 2 and 3A, it will be seen that the floral arrangement comprises a plurality of horizontal layers wherein the stems of each flower 37 in each of the top layers is cut shorter than the stems of the flowers in the layer below allowing the flowers to be arranged in an attractive inclined bed as shown. A wedge-shaped support pad 60 is provided on the underside of outer lid 34 and has a sloped surface 62 corresponding to the incline of the bed of flowers 37. In the illustrated embodiment, a relatively thin backing pad 64 is interposed between pad 60 and outer lid 34 and a relatively thin end pad 66 is interposed between the end of wedge-shaped pad 60 and one of the end flaps 40, but those of skill in the art will appreciate that inclusion of thin pads 64 and 66 is optional and that the wedge-shaped pad 60 may be attached directly to the outer lid 34 as seen in FIG. 3A. In another embodiment shown in FIGS. 7 and 8, wedge-shaped pad 60 is attached to a detached backing plate 104 on the back side 106 of which are provided a plurality of slots 108 for attaching a note card 110.

Figure 6:
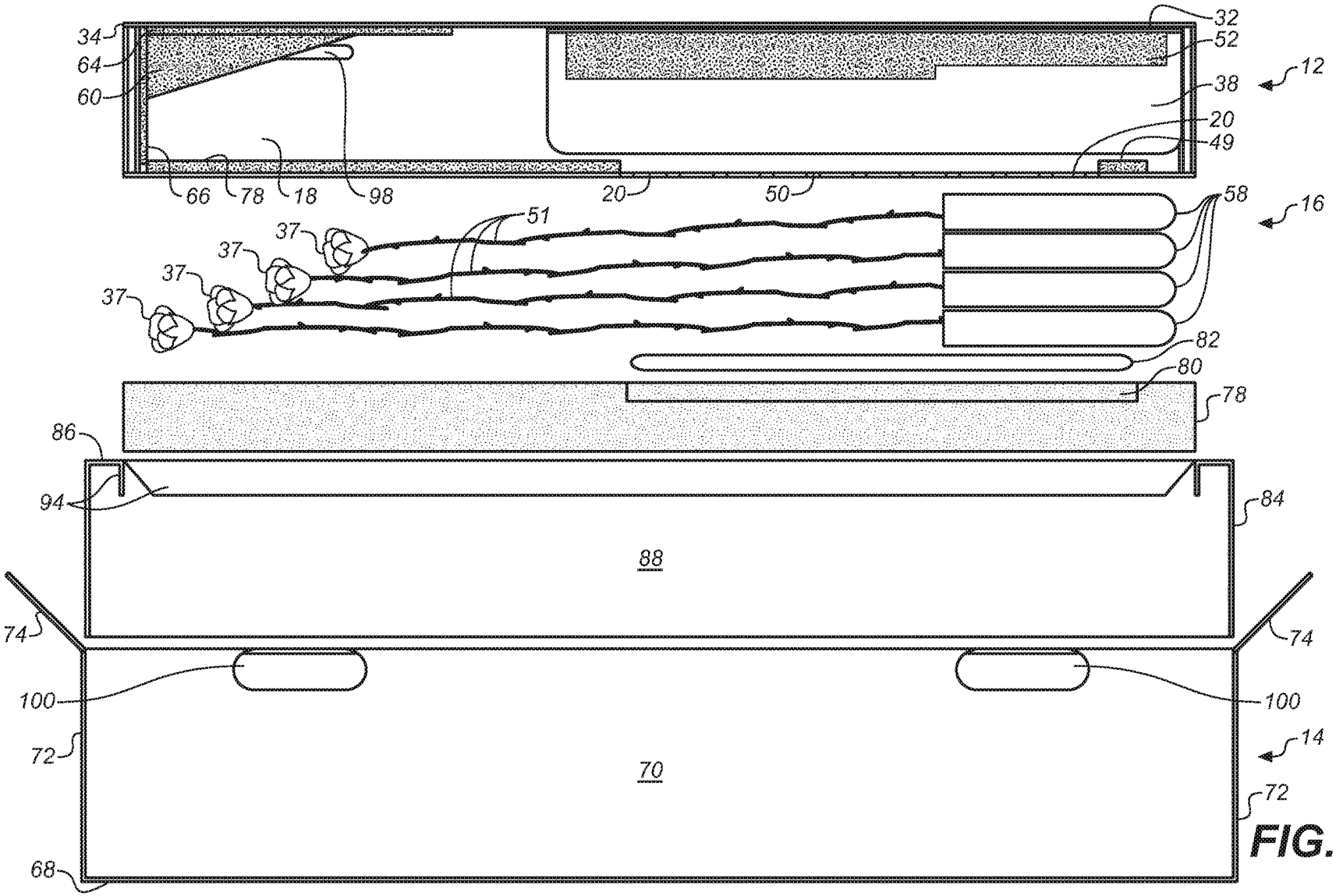
FIG. 6 is an exploded side elevation and partially sectional view of the presentation box, with a representative floral arrangement, and an exploded view of the shipping box thereof.

With reference now to FIG. 6, it can be seen that, when inner and outer lids 32, 34 are closed over the top opening of the presentation box 12, stem-holding pad 52 will hold the stems 51 and hydration tubes 58 of a floral arrangement 16 securely in position, and wedge-shaped pad 60 will gently hold the delicate flowers 37 of the arrangement 16 in their inclined configuration and prevent excess jostling.

With reference to FIGS. 1, 2, 5 and 6, it is seen that the shipping box 14 is an elongated container comprising a bottom panel 68, elongated side panels 70, end panels 72 extending between side panels 70, end lids 74 hingedly connected to end panels 72, and elongated side lids 76 hingedly connected to side panels 70. A floor pad 78 is affixed to the bottom panel 68 and includes a recess 80 for holding a cold pack 82. A spacer 84 in a folded configuration has top panel 86 and elongated side walls 88 and end walls 90 depending from the outer edges of top panel 86. A rectangular opening 92 in top panel 86 is inset from the outer edges thereof and sized to correspond to the width and length of the presentation box 12. Guide flaps 94 are extend inwardly from and are hingedly attached to the inside edges of top panel 86.

A floral arrangement 16 is packaged for shipping by placing the floral arrangement 16 in the presentation box 12 as shown. Inner lid 32 is then closed over the floral arrangement with closure panel 38 introduced between the floral arrangement 16 and adjacent side panel 18. Closure panel 38 holds inner lid 32 in place when the outer lid 34 of the presentation box 12 is opened so that only the flowers 37 of the arrangement 16 are shown.

The outer lid 38 is then closed over the inner lid 32 thereby positioning wedge-shaped pad 60 directly over flowers 37, and end flaps 40 are tucked into the head and stem ends 26, 28 of the presentation box 12 adjacent end panels 22, 24. In the alternate embodiment shown in FIGS. 7 and 8, the wedge-shaped pad 60 and detached backing plate 104 are placed directly over flowers 37 before closing outer lid 38. In either embodiment, the locking panel 42 is then folded over and against side panel 18 and locking flaps 44 are pressed into slots 46 in the head and stem ends 26, 28 of the box thereby securing outer lid 38 over the top opening 30 of the presentation box.

The shipping box 14 is prepared to receive the presentation box 12 by inserting spacer 84 into it, placing a cold pack 82 in the recess 80 of floor pad 78, and then inserting the presentation box 12 in rectangular opening 92 formed by spacer 84 until it is seated on floor pad 78. As seen in FIG. 3, vents 50 in the floor panel 20 of presentation box 12 overlay cold pack 82 allowing cooling air into the interior of presentation box 12 during shipping. Guide flaps 94 press inwardly on presentation box 12 to help hold it in position in opening 92. Finally, end and side lids 74, 76 are closed over presentation box 12 as indicated by arrows A in FIG. 5A.

Figure 5:
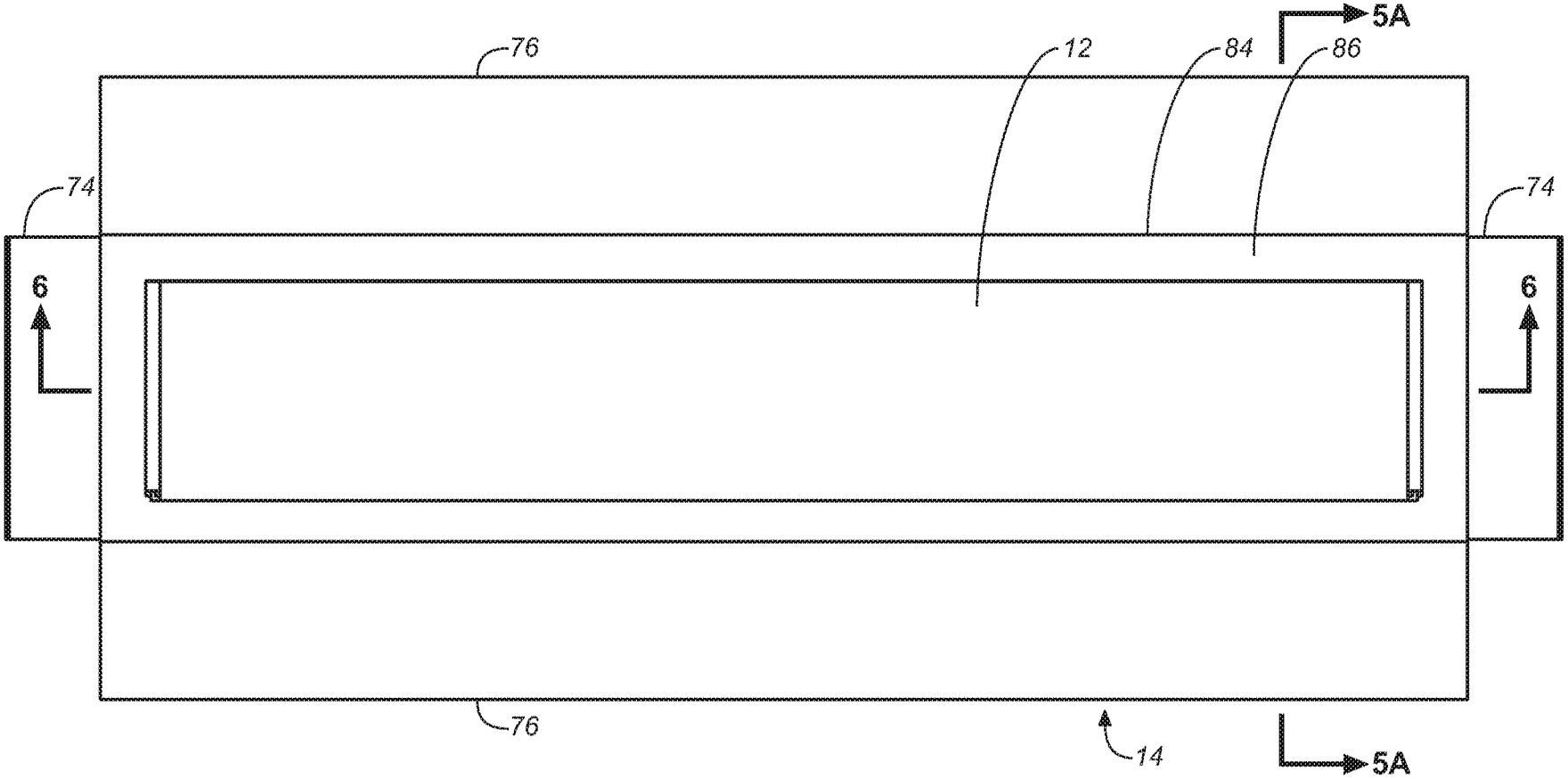
FIG. 5 is a top plan view of the shipping box with the lids open and the presentation box in it.
Figure 5A:
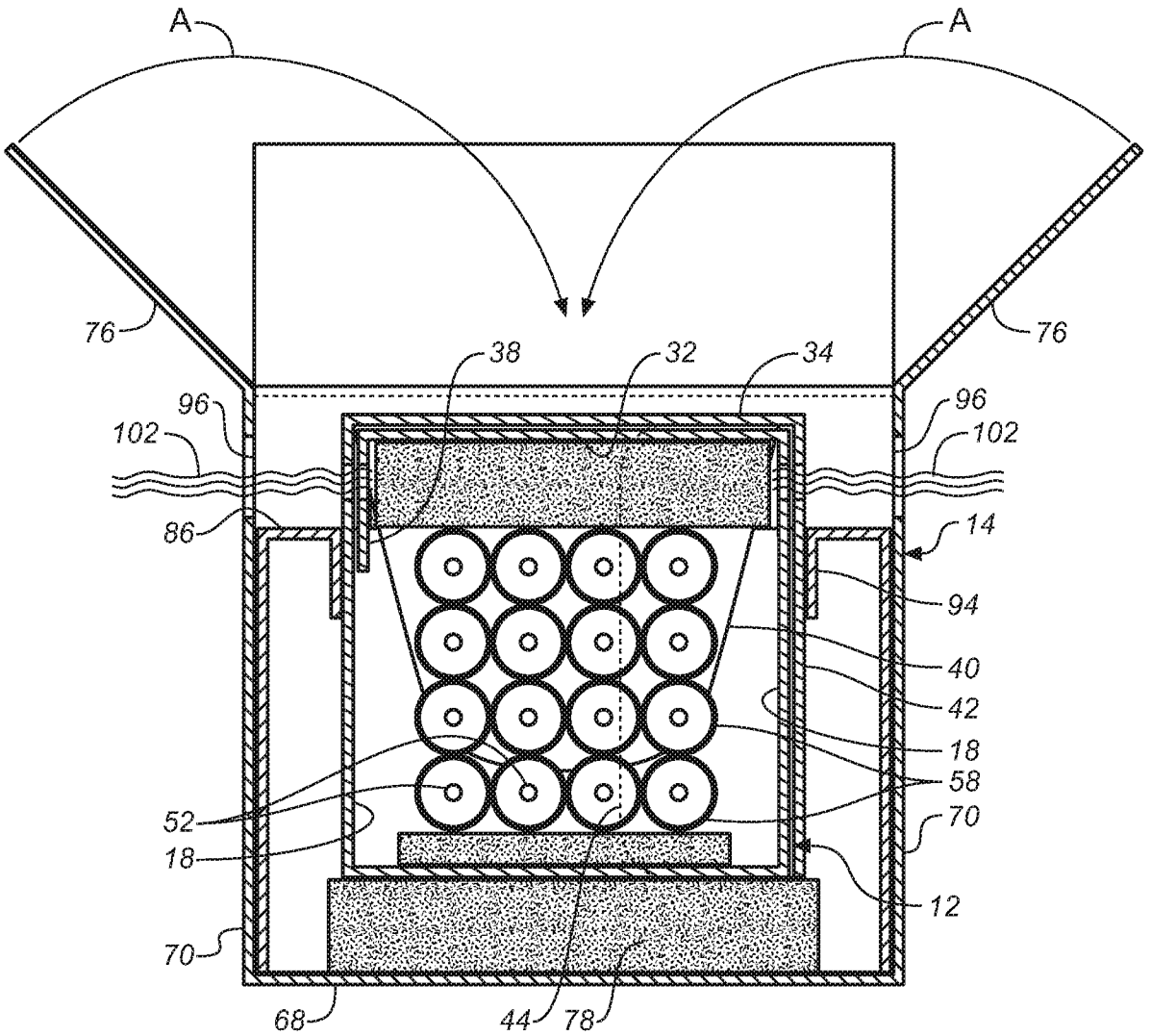
FIG. 5A is a sectional view of the assembled packaging system taken along lines 5A-5A of FIG. 5 showing the presentation box in the shipping box.

As seen in FIG. 5A, when the presentation box 12 is fully inserted in shipping box 14, the outer lid 34 is flush with the upper edges of the side panels 70 of the shipping box 14, but top panel 86 of spacer insert 84 is disposed at a lower level such that a circulation channel 96 extending around the upper end of the presentation box 12 is defined by the side panels 70 of the shipping box, the top panel 86 of the spacer insert 84, the side panels 18 of the presentation box 12 and the end and side lids 74, 76 of the shipping box 14 when it is closed. Closed lids 74, 76 press directly on presentation box 12, holding it in position vertically in shipping box 14.

It can be seen in FIGS. 1, 2 and 3 that ventilation slots 98 are provided in the side panels 18 of the presentation box 12 and in the closure panel 38 and locking panel 42 thereof. When the presentation box 12 is closed as described above, with the closure and locking panels 38, 42 disposed adjacent side panels 18, the ventilation slots 98 in side panels 18, closure panel 38 and locking panel 42 are brought into alignment. When the presentation box 12 is enclosed in the shipping box 14, the ventilation slots 98 are in direct communication with circulation channel 96 as shown in FIG. 5A. Ventilation holes 100 in the upper end of side panels 70 of shipping box 14 allow circulation of outside air 102 into and around the circulation channel 96 and into the interior of the presentation box 12 providing a constant supply of fresh air for the flowers.

Figure 9A:
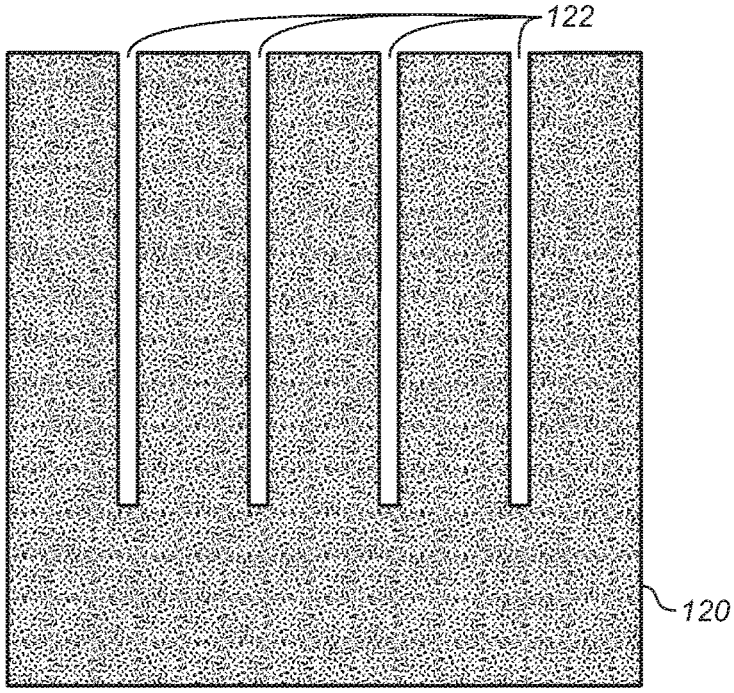
FIG. 9A is an elevation view of the front side of a support block in another embodiment of the invention.
Figure 9B:
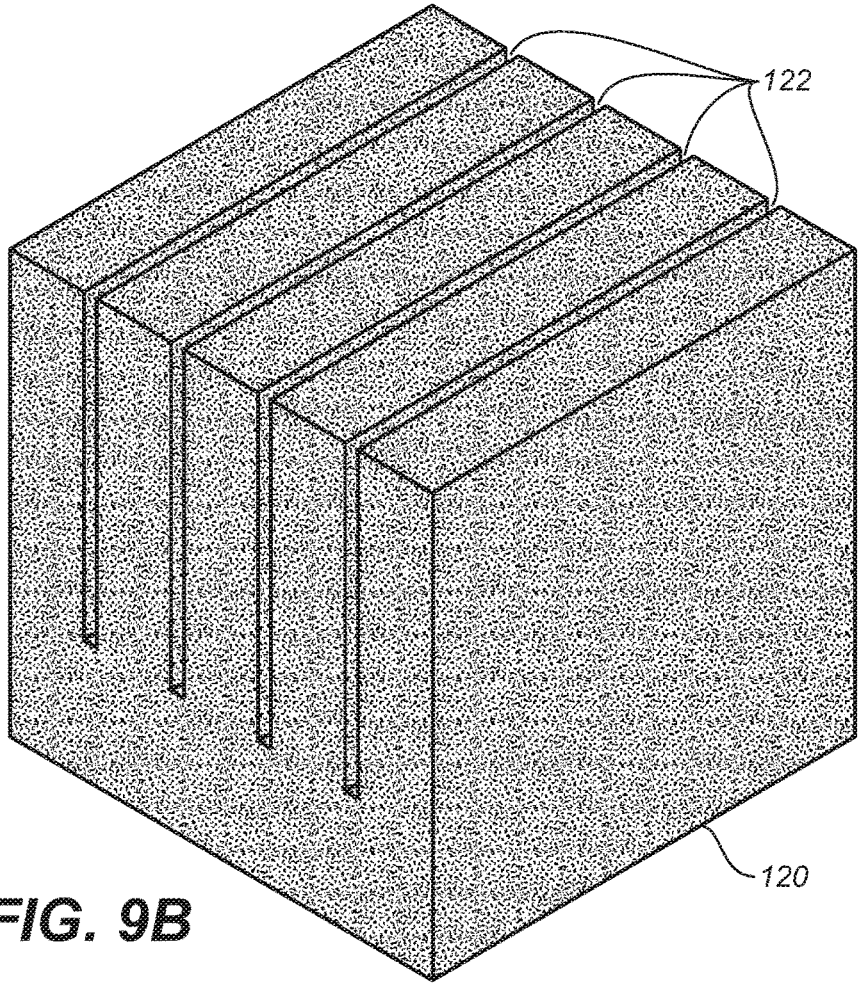
FIG. 9B is a top perspective view thereof.
Figure 10:
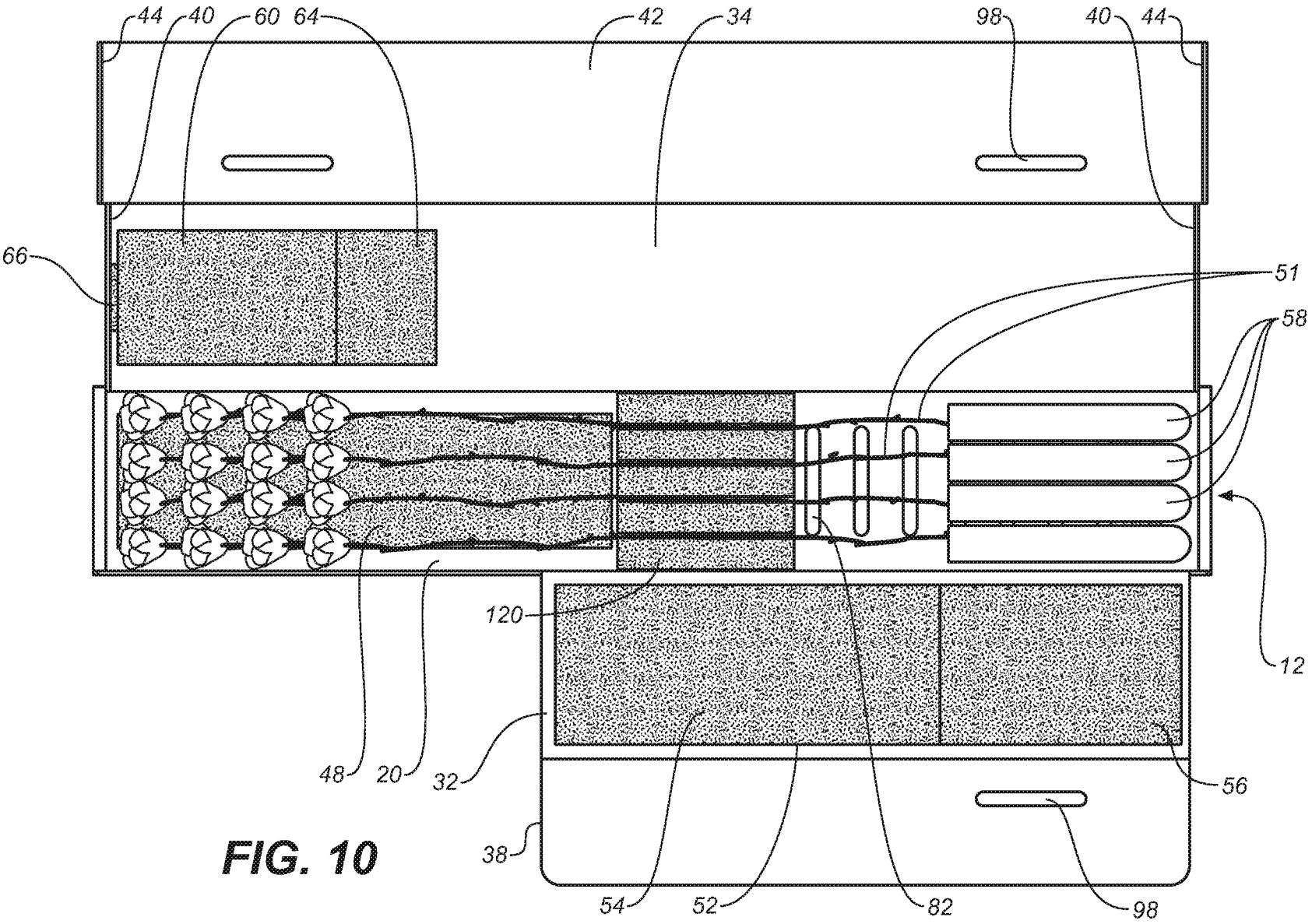
FIG. 10 is a top plan view of the presentation box with the support block of FIGS. 9A and 9B inserted therein.

In another embodiment of the invention, a support block 120 is provided for holding the stems of the flowers of the floral arrangement in parallel alignment with each other and for preventing shifting of the floral arrangement during shipment of the packaging system. As shown in FIGS. 9 and 10, the support block has a width correspond with the width of the floor panel of the presentation box 12 such that the support block fits snugly into the presentation box 12. Alignment slots 122 on the top surface of the support block extend along the entire length thereof and have sufficient depth to receive one or more layers of flower stems. FIG. 10 shows the support block 120 inserted into the presentation box 12 and being used to hold multiple layers of flower stems securely in parallel alignment with each other.

The presentation box 12, shipping box 14, spacer 84 and support block 120 comprise cardboard, card stock, foam, plastic or other materials commonly known in the art of manufacturing folded boxes, shipping containers and spacer inserts.

There have thus been described and illustrated certain embodiments of a packaging system for shipping floral arrangements according to the invention. Although the present invention has been described and illustrated in detail, it should be clearly understood that the disclosure is illustrative only and is not to be taken as limiting.

What we claim is:

1. A packaging system for shipping floral arrangements, the packaging system comprising:

an elongated presentation box sized to hold a floral arrangement, the presentation box including two long side panels, a floor panel extending between the side panels, a head end panel and a stem end panel each extending between the side and floor panels, a top opening defined by the side and end panels, an elongated inner lid hingedly connected on one of its long sides to one of the side panels and extending longitudinally from a first end adjacent to the stem end panel to a second end spaced away from the head end panel, and an elongated outer lid hingedly connected on one of its long sides to the other side panel of the presentation box and extending longitudinally along the top opening of the presentation box, a spacer insert, the spacer insert including elongated side panels, end panels extending between the side panels and a top panel extending between the side and end panels, the top panel having an elongated opening inset from the outer edges thereof and sized to correspond to the width and length of the presentation box and having guide flaps that extend inwardly from and are hingedly attached to the inside edges of the top panel, and an elongated shipping container, the shipping container including long side panels, a bottom panel extending between the side panels, end panels extending between the side and bottom panels, a top opening defined by the side and end panels, and lids hingedly connected to each of the side panels and end panels for closing over the top opening, the top opening of the shipping container being sized to correspond to the width and length of the top panel of the spacer insert, a closed configuration of the presentation box in which the inner lid of the presentation box is folded over a portion of the top opening of the presentation box for capturing, one or more stems of one or more flowers of a floral arrangement disposed in the presentation box the inner lid of the presentation box creating a presentation opening bounded by the head end panel, side panels and the second end of the inner lid of the presentation box, the presentation opening for displaying the one or more flowers of the floral arrangement, and in which the outer lid of the presentation box is folded over the inner lid of the presentation box and covers the presentation opening, and an assembled configuration of the packaging system in which the spacer insert is disposed within the shipping container and the presentation box is disposed within the opening in the top panel of the spacer insert.

2. The packaging system of claim 1 further comprising:

one or more bottom ventilation slots in the floor panel of the presentation box for disposition below the one or more stems of the one or more flowers of a floral arrangement disposed in the presentation box.

3. The packaging system of claim 2 further comprising:

a floor support pad disposed on top of the bottom panel of the shipping container, the floor support pad including a recess for holding a cold pack, wherein, when the spacer insert is disposed within the shipping container and the presentation box is disposed within the opening in the top panel of the spacer insert, the one or more bottom ventilation slots in the floor panel of the presentation box are aligned with the recess allowing for direct communication between a cold pack disposed therein and the interior of the presentation box.

4. The packaging system of claim 2 wherein:

when the spacer insert is disposed within the shipping container and the presentation box is disposed within the opening in the top panel of the spacer insert and the lids of the shipping container are closed the outer lid of the presentation box is flush with the upper edges of the side panels of the shipping container and the top panel of the spacer insert is spaced away from the lids of the shipping container such that a circulation channel extending around the upper end of the presentation box is defined by the side panels of the shipping box, the top panel of the spacer, the side panels of the presentation box and the lids of the shipping container.

5. The packaging system of claim 4 wherein:

the presentation box further comprises side ventilation slots in the side panels thereof such that, when the presentation box is disposed within the opening in the top panel of the spacer insert and the spacer insert is disposed within the shipping container, the side ventilation slots are in direct communication with the circulation channel, and the shipping container further comprises upper ventilation holes in the upper end of the side panels thereof such that, when the presentation box is disposed within the opening in the top panel of the spacer insert and the spacer insert is disposed within the shipping container, outside air is allowed to circulate into and around the circulation channel and into the interior of the presentation box via the side ventilation slots for providing a constant supply of fresh air to a flower arrangement stored therein.

6. The packaging system of claim 5 further comprising:

a bottom support pad disposed on the floor panel of the presentation box near the head end panel, the bottom support pad for providing a protective surface on which one or more flowers of a floral arrangement disposed in the presentation box can be supported, a tube-supporting pad disposed on the floor panel of the presentation box near the stem end panel, the tube-supporting pad for providing a protective surface on which one or more hydration tubes for holding one or more stems of the one or more flowers of the flower arrangement can be supported, a stem holding support pad attached to the underside of the inner lid of the presentation box, the stem holding support pad having a thicker portion and a thinner portion, wherein when the inner lid of the presentation box is folded over the top opening of the presentation box, the thicker portion of the support pad is configured to support the one or more stems of the one or more flowers of a floral arrangement and the thinner portion is configured to support one or more hydration tubes disposed on the bottom of the one or more stems, and a wedge-shaped support pad attached to the underside of the outer lid of the presentation box and extending longitudinally from a first end adjacent to the head end panel to a second end spaced away from the stem end panel such that, when the outer lid is folded over the inner lid of the presentation box, the wedge-shaped support pad is disposed within the presentation opening, the wedge-shaped support pad having a sloped surface for securing and stabilizing an inclined bed of flowers of the flower arrangement.

7. The packaging system of claim 1 further comprising:

a bottom support pad disposed on the floor panel of the presentation box near the head end panel, the bottom support pad for providing a protective surface on which one or more flowers of a floral arrangement disposed in the presentation box can be supported, and a tube-supporting pad disposed on the floor panel of the presentation box near the stem end panel, the tube-supporting pad for providing a protective surface on which one or more hydration tubes for holding one or more stems of one or more flowers of a flower arrangement can be supported.

8. The packaging system of claim 1 further comprising:

a support block sized to fit snugly into the presentation box, and one or more alignment slots on the top surface of the support block extending along the length thereof, each of the alignment slots having a depth sufficient to receive One or more layers of stems of flowers of a floral arrangement disposed in the presentation box, the support block and alignment slots for securely holding the layers of stems in parallel alignment and for preventing the floral arrangement from shifting during shipment of the packaging system.

9. A packaging system for shipping floral arrangements, the packaging system comprising:

an elongated presentation box sized to hold a floral arrangement, the presentation box including two long side panels, a floor panel extending between the side panels, a head end panel and a stem end panel each extending between the side and floor panels, a top opening defined b the side and end panels, an elongated inner lid hingedly connected on one of its long sides to one of the side panels and extending longitudinally from a first end adjacent to the stem end panel to a second end spaced away from the head end panel, a closed configuration in which the inner lid is folded over a portion of the top opening for capturing one or more stems of one or more flowers of a floral arrangement disposed in the presentation box, and in which the inner lid creates a presentation opening bounded by the head end panel, side panels and the second end of the inner lid, the presentation opening for displaying the one or more flowers of the floral arrangement, and a stem holding support pad attached to the underside of the inner lid panel, the stem holding support pad having a thicker portion and a thinner portion, wherein when the inner lid is folded over the top opening, the thicker portion is configured to support one or more stems of one or more flowers of a floral arrangement stored in the presentation box and the thinner portion is configured to support one or more hydration tubes disposed on the bottom of the one or more stems.

10. The packaging system of claim 9 further comprising:

a bottom support pad disposed on the floor panel of the presentation box near the head end panel, the bottom support pad for providing a protective surface on which one or more flowers of a floral arrangement disposed in the presentation box can be supported, and a tube-supporting pad disposed on the floor panel of the presentation box near the stem end panel, the tube-supporting pad for providing a protective surface on which one or more hydration tubes for holding one or more stems of one or more flowers of a flower arrangement can be supported.

11. The packaging system of claim 9 further comprising:

a support block sized to fit snugly into the presentation box, and one or more alignment slots on the top surface of the support block extending along the length thereof, each of the alignment slots having a depth sufficient to receive one or more layers of stems of flowers of a floral arrangement disposed in the presentation box, the support block and alignment slots for securely holding the layers of stems in parallel alignment and for preventing the floral arrangement from shifting during shipment of the packaging system.

12. A packaging system for shipping floral arrangements, the packaging system comprising:

an elongated presentation box sized to hold a floral arrangement, the presentation box including two long side panels, a floor panel extending between the side panels, a head end panel and a stem end panel each extending between the side and floor panels, a top opening defined by the side and end panels an elongated inner lid hingedly connected on one of its long sides to one of the side panels and extending longitudinally from a first end adjacent to the stem end panel to a second end spaced away from the head end panel, and an elongated outer lid hingedly connected on one of its long sides to the other side panel of the presentation box and extending longitudinally along the top opening, of the presentation box, a closed configuration of the presentation box in which the inner lid is folded over a portion of the top opening for capturing one or more stems of one or more flowers of a floral arrangement disposed in the presentation box, the inner lid creating a presentation opening bounded by the head end panel, side panels and the second end of the inner lid, the presentation opening for displaying the one or more flowers of the floral arrangement, and in which the outer lid is folded over the inner lid and covers the presentation opening, and a wedge-shaped support pad attached to the underside of the outer lid and extending longitudinally from a first end adjacent to the head end panel to a second end spaced away from the stem end panel such that, when the outer lid is folded over the inner lid, the wedge-shaped support pad is disposed within the presentation opening, the wedge-shaped support pad having a sloped surface for securing and stabilizing an inclined bed of flowers of a flower arrangement disposed in the presentation box.

13. A packaging system for shipping floral arrangements, the packaging system comprising:

an elongated presentation box sized to hold a floral arrangement, the presentation box including two long side panels, a floor panel extending between the side panels, a head end panel and a stem end panel each extending between the side and floor panels, a top opening defined by the side and end panels, an elongated inner lid hingedly connected on one of its long sides to one of the side panels and extending longitudinally from a first end adjacent to the stem end panel to a second end spaced away from the head end panel, and an elongated outer lid hingedly connected on one of its long sides to the other side panel of the presentation box and extending longitudinally along the top opening of the presentation box, a closed configuration of the presentation box in which the inner lid is folded over a portion of the top opening for capturing one or more stems of one or more flowers of a floral arrangement disposed in the presentation box, the inner lid creating a presentation opening bounded by the head end panel, side panels and the second end of the inner lid, the presentation opening for displaying the one or more flowers of the floral arrangement, and in which the outer lid is folded over the inner lid and covers the presentation opening, and a plate and a wedge-shaped support pad attached to the underside of the plate, the wedge-shaped support pad having a sloped surface for securing and stabilizing an inclined bed of flowers of a flower arrangement disposed in the presentation box and the plate being sized to fit within the presentation opening of the presentation box such that, the plate and attached wedge-shaped support pad are configured to be disposed directly over one or more flowers of a flower arrangement placed in the presentation box.

14. A packaging sys for shipping floral arrangements, the packaging system comprising:

an elongated presentation box sized to hold a floral arrangement, the presentation box including two long side panels, a floor panel extending between the side panels, a head end panel and a stem end panel each extending between the side and floor panels, a top opening defined by the side and end panels, an elongated inner lid hingedly connected on one of its long sides to one of the side panels and extending longitudinally from a first end adjacent to the stem end panel to a second end spaced away from the head end panel, and an elongated outer lid for concealing the flowers of a floral arrangement disposed in the presentation box, the outer lid hingedly connected on one of its long sides to the other side panel of the presentation box and extending longitudinally along the top opening thereof, a bottom support pad disposed on the floor panel of the presentation box near the head end panel, the bottom support pad for providing a protective surface on which one or more flowers of a floral arrangement can be supported, a tube-supporting pad disposed on the floor panel of the presentation box near the stem end panel, the tube-supporting pad for providing a protective surface on which one or more hydration tubes for holding one or more stems of one or more flowers of a flower arrangement can be supported, a wedge-shaped support pad attached to the underside of the outer lid and extending longitudinally from a first end adjacent to the head end panel to a second end spaced away from the stem end panel, and a closed configuration in which the inner lid is folded over a portion of the top opening and creates a presentation opening bounded by the head end panel, side panels and the second end of the inner lid, the presentation opening for displaying one or more flowers of a floral arrangement, and in which the outer lid is folded over the inner lid of the presentation box and covers the presentation opening and the wedge-shaped support pad attached to the underside of the outer lid is disposed within the presentation opening.

* * * * *